US005136269A

United States Patent [19]

Seitzer et al.

[11] Patent Number: 5,136,269

[45] Date of Patent: Aug. 4, 1992

[54] HIGH-FREQUENCY BAND-PASS FILTER HAVING MULTIPLE RESONATORS FOR PROVIDING HIGH PASS-BAND ATTENUATION

[75] Inventors: Dieter Seitzer, Erlangen; Thomas Brockdorff, Coburg, both of Fed. Rep. of Germany

[73] Assignee: Fraunhofer Gesellschaft zur Forderund der angewandten Forschung EV, Munich, Fed. Rep. of Germany

[21] Appl. No.: 660,560

[22] Filed: Feb. 22, 1991

[51] Int. Cl.[5] ..... H01P 1/203

[52] U.S. Cl. ..... 333/204; 333/205

[58] Field of Search ..... 333/202-205, 333/219, 246

[56] References Cited

U.S. PATENT DOCUMENTS

| | | | |
|---|---|---|---|
| 4,578,656 | 3/1986 | Lacour et al. | 333/205 X |
| 4,992,759 | 2/1991 | Giraudeau et al. | 333/204 |
| 5,021,757 | 6/1991 | Kobayashi et al. | 333/204 X |

FOREIGN PATENT DOCUMENTS

| | | |
|---|---|---|
| 0071509 | 6/1983 | European Pat. Off. . |
| 2613538 | 10/1988 | France . |
| 0177001 | 8/1986 | Japan . |

OTHER PUBLICATIONS

Rizzoli et al, "Vector Processing concepts in microwave circuit design", 14th European Microwave Conf. Sep. 13, 1984, pp. 847-852.

Lotkova, "The Design of Microstrip filters employing coupled lines", 1298 Telecommunication & Radio Engin. Apr. 4, 1987, pp. 70-72.

Fechner, "Microstrip Elliptic Function Bandpass filters", 2213 Frequenz, vol. 34, No. 5, Mar., 1980, pp. 78-89.

Rhodes, "Suspended Substrate Filters and Multiplexers", 16th European Microwave Conf. Sep. 12, 1986, pp. 8-18.

Matthaei, "Comb-line Band-pass filters of Narrow or Moderate Bandwidth", The microwave journal, Aug. 1963, pp. 82-91.

*Primary Examiner*—Eugene R. Laroche
*Assistant Examiner*—Seung Ham
*Attorney, Agent, or Firm*—Harry M. Weiss

[57] ABSTRACT

A high-frequency band-pass filter has an input resonator, a middle resonator and an output resonator which are coupled in parallel. The input resonator and the output resonator are capacitively shortened quarter-wave line resonators. To improve the attenuation characteristics, the middle resonator is designed as a capacitively shortened half-wave resonator. The input resonator extends along a first part of the length of the middle resonator. The output resonator extends along a second part of the length of the middle resonator.

20 Claims, 2 Drawing Sheets

HIGH-FREQUENCY BAND-PASS FILTER HAVING MULTIPLE RESONATORS FOR PROVIDING HIGH PASS-BAND ATTENUATION

The present invention concerns a high-frequency band-pass filter according to the generic part of Patent claim 1.

A high-frequency band-pass filter of this genre is known from the textbook "Zinke/Brunswig: Lehrbuch der Hochfrequenztechnik [Textbook of High-Frequency Engineering], Vol. 1, 3rd edition, Springer Publishing Company, 1986, p. 209, FIG. 4.14/9." This well-known high-frequency band-pass filter involves a so-called interdigital filter with capacitively shortened resonator inner conductors. In this high-frequency band-pass filter, an input line resonator, a middle line resonator and an output line resonator are connected in parallel to one another in such a way that a coupling is established between the input line resonator and the middle line resonator, and between the middle line resonator and the output line resonator. This coupling involves a so-called coupling of parallel lines. In the case of this well-known interdigital filter with three capacitively shortened quarter-wave resonators, there arises a desirable shift of the closest pass-band region, which in the case of half-wave resonators lies at double the resonance frequency, to higher frequencies. Thus a good attenuation can be attained at the first harmonic of the medium frequency of the pass band. On the other hand, the degree of coupling of this well-known interdigital filter cannot be increased at will, thus the attenuation at the resonance frequency direct coupling of the input resonator with the output resonator. This [coupling] would, for its part, impair the stop-band characteristics of the interdigital filter.

Furthermore, from the Textbook of High-Frequency Engineering cited above, p. 207, FIG. 4.14/6 another band-pass filter is known which has half-wave resonators coupled in parallel. The known band-pass filter is actualized through strip or microstrip engineering. It encompasses a plurality of half-wave strip line resonators on a substrate, which [resonators] are staggered in longitudinal direction with respect to one another by quarter waves. A high-frequency band-pass filter structure of this kind has large external dimensions. Furthermore, an unshortened high-frequency band-pass filter of this kind cannot be tuned, and it has a relatively low attenuation at the first harmonic.

From the standard textbook "Meinke/Gundlach, Taschenbuch der Hochfrequenztechnik [Pocket Edition of High-Frequency Engineering], 4th edition, Springer Publishing Company, 1986," Sections F14 through F19 in conjunction with FIG. 27, various coupled line circuits which form a band pass are known.

From the EP-Bl-0117178, FIG. 1, a high-frequency band-pass filter in strip line engineering is known, which [filter] has an input coupling line, two middle resonators and an output coupling line. The input coupling line and the output coupling line are in each case executed as open-circuit lines and as capacitive coupling elements which are arranged parallel to one another and not staggered in the direction of their longitudinal extension, thus at the same height. The two middle resonators are designed as U-shaped, capacitively shortened half-wave resonators, the ends of which are connected to ground potential, and the middles of which are in each case connected with one capacitor. The input coupling line and the output coupling line form purely capacitive couplings to a relatively low-resistance point of the middle resonators. The filter structure as a whole cannot be tuned and it does not have an adjustable degree of coupling. With this filter, it is not possible to properly tune it in its medium frequency over a rather broad frequency range.

The present invention is based upon the problem vis-a-vis this prior art of further developing a high-frequency band-pass filter of the kind mentioned initially in such a manner that a filter can be achieved with which, while it is simple to manufacture and has small external dimensions, one can attain a low pass-band attenuation at a high attenuation particularly in the range of the first harmonic, that is, the first harmonic oscillation.

This problem is solved according to the invention by means of a high-frequency band-pass filter according to the generic part of Patent claim 1 by the features stated in the characterizing part of Patent claim 1.

The inventive high-frequency band-pass filter prevents a direct coupling of the input resonator to the output resonator by means of their staggered arrangement in the longitudinal direction of the middle resonator. By means of this arrangement, one can attain a high degree of coupling which makes possible a transmission loss of only 1 to 2.5 dB at the transmission frequency without this resulting in a wave formation of the attenuation characteristic in the frequency range, which customarily occurs in the event of such a high degree of coupling. The inventive high-frequency band-pass filter not only displays the very high pass-band attenuation just discussed, but it also offers, depending upon the degree of coupling and the band width of the pass band, an attenuation of up to −70 dB at the first harmonic.

A significant advantage of the inventive filter can be found in that its characteristics can be simulated by computer, something which is not the case for many known filter structures, or which can only be approximated with a considerable outlay.

The inventive filter is suitable for tuning for capacitors with adjustable capacitance values or trimmers, and it can be constructed compactly and inexpensively in microstrip engineering.

Due to its low pass-band attenuation, the area of application of the inventive line filter appears not to be limited to frequency processing. Rather, it appears fundamentally possible to employ the inventive filter in the power range as well.

A preferred embodiment form of the inventive filter will be explained in more detail in the following, with reference to the enclosed drawings.

Figure 1:
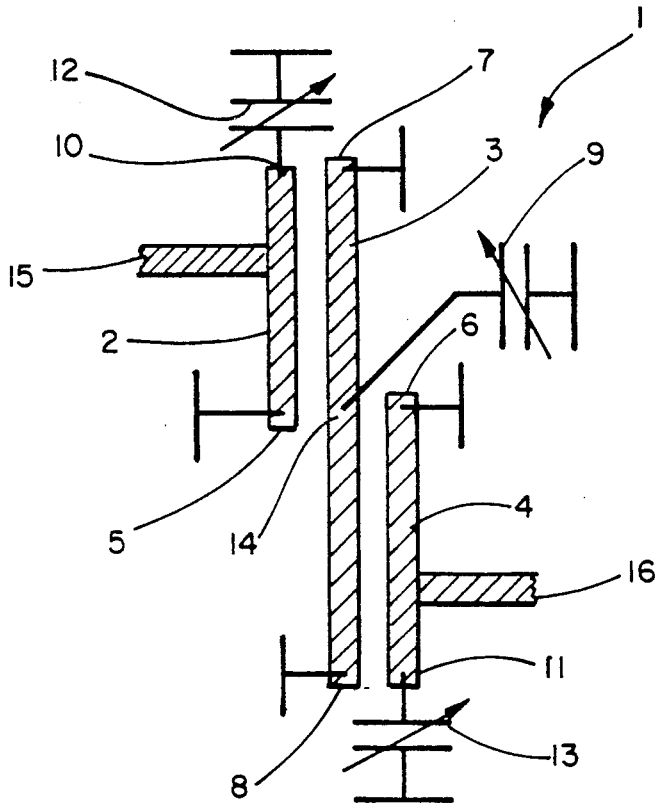
FIG. 1 shows a structure of one embodiment form of the filter according to the invention.

As shown in FIG. 1, the inventive high-frequency band-pass filter of the third order, designated in its totality with the reference number 1, encompasses an input resonator 2, a middle resonator 3 and an output resonator 4. The resonators 2, 3, and 4 are developed on a substrate as line resonators in strip or microstrip engineering by means of the usual etching technique. In the case of the preferred embodiment form which is shown, the substrate has a thickness of approximately 1.5 mm with a relative permeability or effective dielectricity number EPSILON$_R$ ($E_R$) of approximately 4.0.

The input resonator 2 is coupled in parallel with the middle resonator 3. The middle resonator 3 is, for its part, coupled in parallel with the output resonator 4. The facing ends 5, 6 of the input resonator 2 and the output resonator 4 are connected to ground. Also, the two ends 7, 8 of the middle resonator 3 are connected to ground. The midpoint of the middle resonator 3 is connected across a first adjustable capacitor 9 to ground. The opposite ends 10, 11 of the input resonator 2 and the output resonator 4 are also connected across a second, or, respectively, third adjustable capacitor, 12, 13 to ground.

The input resonator 2 lies parallel to the middle resonator 3 between an end 7 and the midpoint 14 of the middle resonator 3. The output resonator 4 lies parallel to the middle resonator 3 between the midpoint 14 of the middle resonator 3 and its other end 8. Due to this mutual staggering of the input resonator and the output resonator, an undesired direct coupling of the input resonator to the output resonator, which would lead to a weakening of the attenuation outside of the transmission frequency, is avoided to a great extent.

The input resonator 2 and the output resonator 4, in conjunction with the second, or, respectively, third capacitor 12, 13 which are associated with them, form capacitively shortened quarter-wave line resonators, the electrical length of which is adjusted by means of a suitable selection of the capacitance value of the second, or, respectively, third capacitor 12, 13 at 10% to 30%, preferably approx. 15%, of the length of a quarter-wave line resonator.

The middle resonator 3, in conjunction with the first capacitor which is associated with it, forms a shortened half-wave line resonator, the length of which is adjusted by means of a suitable selection of the capacitance value of the first capacitor also to 10% to 30%, but preferably approximately 16%, of the length of a half-wave resonator.

The capacitance value of the first capacitor 9 corresponds with approximately 2% precision to double the capacitance value of the second, or, respectively, third capacitor 12, 13. The ratio of the capacitance values results from the line lengths. One can change the lengths independently of one another within certain limits, and this will bring with it a corresponding change in the capacitance values.

The outside line elements 2, 4 can be shifted slightly in parallel to the middle line 3, thereby facilitating the placement of the middle capacitor 9.

As is generally known, the relative effective electrical permeability shrinks with the root of its reciprocal value into the length of the line resonators 2, 3, 4. (Compare "Erich Pehl: Mikrowellentechnik [Microwave Engineering]," p. 87 ff.)

In the case of a relative permeability of approximately 4.0 with a ratio of conductor width to substrate thickness of 1.33, this leads to a further reduction of the dimensions to approximately 58% of the value which would result with a relative permeability of 1.

The input resonator 2 is connected by means of a direct tap with an input connecting line 15. Correspondingly, the output resonator 4 is connected by means of a direct tap with an output connecting line 16. Instead of the coupling of the input connecting line 15 and the output connecting line 16 by means of a direct tap, in deviation from the embodiment example shown, any other coupling can also be used.

In the case of a practically actualized embodiment form in microstrip engineering for a pass-band frequency $f_B$ of 400 MHz and with a relative permeability of the substrate of EPSILON$_R$=4.0, the following dimensions were chosen: The capacitance of the second and third capacitors 12, 13 is 18.6 pF, and that of the first capacitor 9 is 36.6 pF. The lengths of the input resonator and the output resonator 2, 4 are 17 mm. The length of the middle resonator 3 is 34 mm. The connecting lines 15, 16 with a characteristic wave impedance of 50 ohms are located at a distance of 4.8 mm from the opposite ends 10, 11 of the input resonator 2, or, respectively, the output resonator 4.

A significant advantage of the inventive high-frequency band-pass filter 1 consists in that its attenuation characteristic can be computer-simulated. The results of this type of simulation are depicted in FIG. 2.

Figure 2:
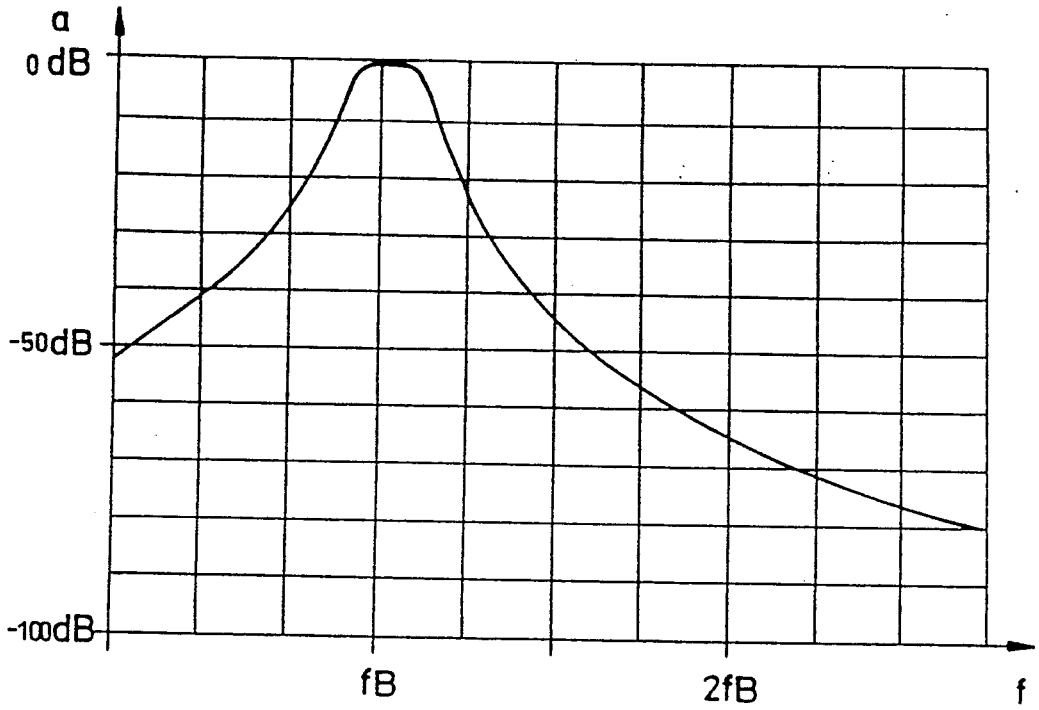
FIG. 2 shows a computer-generated simulation of the attenuation characteristic of the embodiment form according to FIG. 1.

As can be seen in FIG. 2, the computer-generated attenuation characteristic shows a pass-band attenuation of less than −1 dB and an attenuation of −65 DB in the case of double the pass-band frequency 2 $f_B$.

Figure 3:
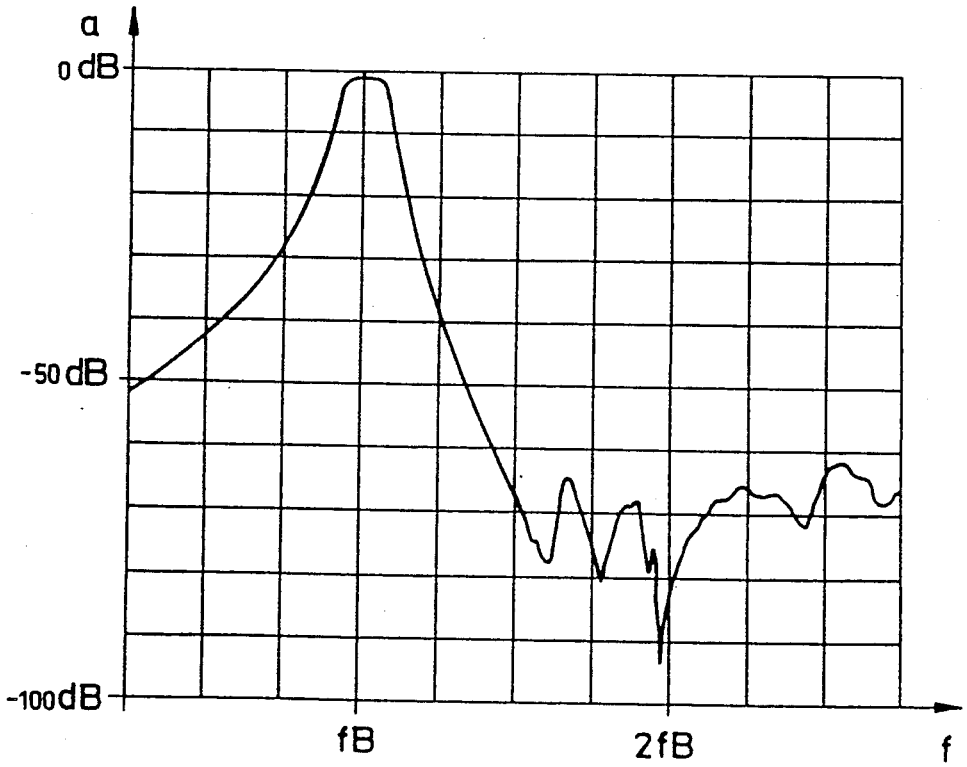
FIG. 3 shows the results of measurement of the attenuation characteristic of the embodiment form according to FIG. 1.

From a comparison with FIG. 3, which shows the actual measured attenuation characteristic of the embodiment form of the inventive high-frequency band-pass filter with the dimensioning cited above, it is clear that the computer-generated attenuation characteristic according to FIG. 2 matches the actual measured attenuation characteristic according to FIG. 3 relatively well. In the case of the measurement which forms the basis of FIG. 3, a pass-band attenuation of −1.2 dB with the pass-band frequency $f_B$ of 400 MHz was achieved The attenuation at the first harmonic 2 $f_B$ is better than −70 dB.

To the person skilled in the art, it is a particularly striking aspect of the attenuation characteristic shown in FIG. 3 that a very high degree of coupling is attained at the band-pass frequency $f_B$, without one having to accept along with this the wave formation of the attenuation characteristic in the frequency range which is usual with such high degrees of coupling, as occurs in the case of filters with two resonators which are coupled in parallel.

The embodiment example of the inventive band-pass filter shown displays a very wide tuning range of from 360 MHz to 960 MHz with an almost constant efficiency.

A considerable advantage of the inventive high-frequency band-pass filter consists in the fact that its attenuation behavior can be computer-simulated with a low outlay using programs which are known per se, something which is not possible in the case of, for example, an interdigital filter with more than two resonators.

The preferred embodiment example depicted is actualized in strip engineering. However, it will be obvious to the person skilled in the art of high-frequency engineering that in addition to that technology [strip engineering], other suitable technology, for example, the technology of air conduction, can be employed. Actualization in strip line engineering or microstrip engineering appears to be the most cost-effective solution, however.

Preferred areas of application for the inventive filter lie in the field of frequency processing engineering for frequencies between approximately 50 MHz and 10 Ghz. It is also conceivable that the inventive filter could be used as an output filter for low-power transmitters to suppress harmonic waves.

We claim:

1. High-frequency band-pass filter comprising an input resonator (2), a middle resonator (3) and an output resonator (4), the input resonator (2) is coupled in parallel with the middle resonator (3) and the middle resonator (3) is coupled in parallel with the output resonator (4), and the input resonator (2) and the output resonator (4) comprise capacitively shortened quarter-wave line resonators, characterized in that, the middle resonator (3) is designed as a capacitively shortened half-wave line resonator which is connected at both ends (7, 11) to ground and at its center (14) to a first capacitor (9), that the input resonator (2) and the output resonator (4) are staggered with respect to one another in the direction of their longitudinal extension, and that the input resonator (2) extends along a first part of a length of the middle resonator (3) and the output resonator (4) extends along a second part of the length of the middle resonator (3); the input resonator (2) and the output resonator (4) are coupled together with their adjacent facing ends (5, 6) connected to a ground and with their opposite ends (10, 11) respectively connected to a second, and third capacitor (12, 13).

2. High-frequency band-pass filter according to claim 1, characterized in that an input line (15) and an output line (16) are connected with a direct tap to the input resonator (2) and the output resonator (4), respectively, at a point of connection lying between ends (5, 10; 6, 11) of the input and output resonators (2, 4).

3. High-frequency band-pass filter according to claim 1, characterized in that the capacitance of the second or third capacitor, respectively (12, 13) is selected such that the length of the input resonator (12) or, respectively, the output resonator (4) amounts to 10% to 30% of the length of a quarter-wave resonator.

4. High-frequency band-pass filter according to claim 3, characterized in that the length of the input resonator (2) and that of the output resonator (4), respectively, amounts to approximately 15% of the length of a quarter-wave resonator.

5. High-frequency band-pass filter according to claim 1, characterized in that the capacitance of the first capacitor (9) is selected such that the length of the middle resonator (3) amounts to 10% to 30% of the length of a half-wave resonator.

6. High-frequency band-pass filter according to claim 5, characterized in that the length of the middle resonator (3) amounts to approximately 15% of the length of a half-wave resonator.

7. High-frequency band-pass filter according to claim 1, characterized in that the capacitance of the first capacitor (9) corresponds to double the capacitance value of the second or third capacitor (12, 13).

8. High-frequency band-pass filter according to claim 1, characterized in that the filter (1) is developed on a substrate in strip line engineering.

9. High-frequency band-pass filter according to claim 1, characterized in that the filter is designed with lines at a distance from a backing material and surrounded by air as a dielectric.

10. High-frequency band-pass filter according to claim 1, characterized in that the capacitors (9, 12, 13) are adjustable in their capacitance value for the purpose of tuning the band-pass filter (1).

11. A method of operating a high-frequency band-pass filter with an input resonator (2), a middle resonator (3) and an output resonator (4), the input resonator (2) is coupled in parallel with the middle resonator (3) and the middle resonator (3) is coupled in parallel with the output resonator (4), and the input resonator (2) and the output resonator (4) comprise capacitively shortened quarter-wave line resonators comprising the steps of: providing the middle resonator (3) as a capacitively shortened half-wave line resonator which is connected at both ends (7, 11) to ground and at its enter (14) to a first capacitor (9), staggering the input resonator (2) and the output resonator (4) with respect to one another in the direction of their longitudinal extension, and extending the input resonator (2) along a first part of a length of the middle resonator (3) and extending the output resonator (4) along a second part of the length of the middle resonator (3); the input resonator (2) and the output resonator (4) are coupled together with their adjacent facing ends (5, 6) connected to ground and with their opposite ends (10, 11) respectively connected to a second, and third capacitor (12, 13).

12. A method according to claim 11, wherein an input line (15) and an output line (16) are connected with a direct tap to the input resonator (2) and the output resonator (4), respectively, at a point of connection lying between ends (5, 10; 6, 11) of the input and output resonators (2, 4).

13. A method according to claim 11, wherein the capacitance of the second or third capacitor, respectively (12, 13) is selected such that the length of the input resonator (2) or, respectively, the output resonator (4) amounts to 10% or 30% of the length of a quarter-wave resonator.

14. A method according to claim 13, wherein the length of the input resonator (2) and that of the output resonator (4), respectively, amounts to approximately 15% of the length of a quarter-wave resonator.

15. A method according to claim 11, wherein the capacitance of the first capacitor (9) is selected such that the length of the middle resonator (3) amounts to 10% to 30% of the length of a half-wave resonator.

16. A method according to claim 15, wherein the length of the middle resonator (3) amounts to approximately 15% of the length of a half-wave resonator.

17. A method according to claim 11, wherein the capacitance of the first capacitor (9) corresponds to double the capacitance value of the second or third capacitor (12, 13).

18. A method according to claim 11, wherein the filter (1) is developed on a substrate in strip line engineering.

19. A method according to claim 11, wherein the filter is designed with lines at a distance from a backing material and surrounded by air as a dielectric.

20. A method according to claim 11, wherein the capacitors (9, 12, 13) are adjustable in their capacitance value for the purpose of tuning the band-pass filter (1).

* * * * *